US012390682B1

(12) United States Patent
Nolan et al.

(10) Patent No.: US 12,390,682 B1
(45) Date of Patent: Aug. 19, 2025

(54) HANDLE ATTACHMENT SYSTEM FOR USE WITH AN EXERCISE MACHINE

(71) Applicant: Bulletproof Fitness Equipment Inc, Acton, CA (US)

(72) Inventors: Lawrence R. Nolan, Santa Clarita, CA (US); Nicole K. Nolan, Santa Clarita, CA (US); Christopher I. Gaddy, Brooklyn, NY (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 251 days.

(21) Appl. No.: 18/342,433

(22) Filed: Jun. 27, 2023

Related U.S. Application Data

(63) Continuation-in-part of application No. 17/955,302, filed on Sep. 28, 2022, now Pat. No. 12,303,739, which is a continuation-in-part of application No. 17/034,950, filed on Sep. 28, 2020, now Pat. No. 11,517,785, application No. 18/342,433, filed on Jun. 27, 2023 is a continuation-in-part of application No. 17/677,278, filed on Feb. 22, 2022, which is a continuation-in-part of application No. 17/034,950, filed on Sep. 28, 2020, now Pat. No. 11,517,785.

(60) Provisional application No. 63/336,679, filed on Apr. 29, 2022.

(51) Int. Cl.
*A63B 21/00* (2006.01)
*A63B 17/04* (2006.01)

(52) U.S. Cl.
CPC ..... *A63B 21/4035* (2015.10); *A63B 17/04* (2013.01); *A63B 21/156* (2013.01); *A63B 21/4047* (2015.10); *A63B 2225/09* (2013.01)

(58) Field of Classification Search
CPC ... A63B 17/04; A63B 21/156; A63B 21/4035; A63B 21/4047; A63B 21/06; A63B 21/0615; A63B 2225/09
See application file for complete search history.

(56) References Cited

U.S. PATENT DOCUMENTS

| | | | |
|---|---|---|---|
| 5,788,614 | A | 8/1998 | Simonson |
| 6,238,323 | B1 | 5/2001 | Simonson |
| 6,488,612 | B2 | 12/2002 | Sechrest et al. |
| 6,905,446 | B2 | 6/2005 | Greenland |

(Continued)

FOREIGN PATENT DOCUMENTS

WO 2019199352 A1 10/2019

*Primary Examiner* — Megan Anderson
(74) *Attorney, Agent, or Firm* — AVEK IP, LLC

(57) ABSTRACT

A handle attachment system for use with an exercise machine, the handle attachment system includes an attachment mechanism for engaging with the exercise machine; a support extending from a first end to a second end, the support engaged with the attachment mechanism at the first end; an adjustment system engaged with the support at the second end, the handle system having a first connection providing pivoting adjustment along a first axis; a second connection providing pivoting adjustment along a second axis; and a third connection providing pivoting adjustment along a third axis; and a handle attached to the adjustment system such that the handle can be adjusted to a predetermined position pivot along one or more of the first axis, the second axis, and the third axis via an associated one or more of the first connection, the second connection, and the third connection.

9 Claims, 6 Drawing Sheets

(56) References Cited

U.S. PATENT DOCUMENTS

| | | | | |
|---|---|---|---|---|
| 7,223,215 | B2 * | 5/2007 | Bastyr | A63B 21/00185 482/114 |
| 7,641,602 | B2 * | 1/2010 | Rogers | A63B 21/08 482/135 |
| 7,918,771 | B2 | 4/2011 | Rogers et al. | |
| 11,013,945 | B2 | 5/2021 | Sorin et al. | |
| 11,173,337 | B2 | 11/2021 | Jones et al. | |
| 12,194,333 | B2 * | 1/2025 | Crandall | A63B 23/1218 |
| 2017/0056707 | A1 | 3/2017 | Hockridge et al. | |
| 2019/0269963 | A1 * | 9/2019 | Steenekamp | A63B 23/1254 |
| 2022/0323815 | A1 * | 10/2022 | Simental | A63B 21/0557 |

* cited by examiner

HANDLE ATTACHMENT SYSTEM FOR USE WITH AN EXERCISE MACHINE

CROSS-REFERENCE TO RELATED APPLICATIONS

This application is a continuation-in-part of U.S. patent application Ser. No. 17/677,278, filed Feb. 22, 2022, which is a continuation-in-part of U.S. patent application Ser. No. 17/034,950, filed Sep. 28, 2020, which granted as U.S. Pat. No. 11,517,785. This application is also a continuation-in-part of U.S. patent application Ser. No. 17/955,302, filed Sep. 28, 2022, which claims the benefit of priority from U.S. Provisional Patent Application No. 63/336,679, filed Apr. 29, 2022. U.S. Patent Application 17/955,302 is also a continuation-in-part of the '950. The disclosures of each of these applications are incorporated by reference in their entireties herein.

FIELD OF INVENTION

The disclosure relates generally to exercise equipment. More specifically, the disclosure relates to a handle attachment system for use with an exercise machine, wherein the handle attachment system provides for tri-axis adjustability of a handle.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a handle attachment system for use with an exercise machine, the handle attachment system comprising an attachment mechanism for engaging with the exercise machine; a support extending from a first end to a second end, the support engaged with the attachment mechanism at the first end; an adjustment system engaged with the support at the second end, the handle system having a first connection providing pivoting adjustment along a first axis; a second connection providing pivoting adjustment along a second axis; and a third connection providing pivoting adjustment along a third axis; and a handle attached to the adjustment system such that the handle can be adjusted to a predetermined position pivot along one or more of the first axis, the second axis, and the third axis via an associated one or more of the first connection, the second connection, and the third connection.

BRIEF DESCRIPTION OF THE DRAWINGS

Embodiments of the invention are described in detail below with reference to the attached drawings.

Figure 1:
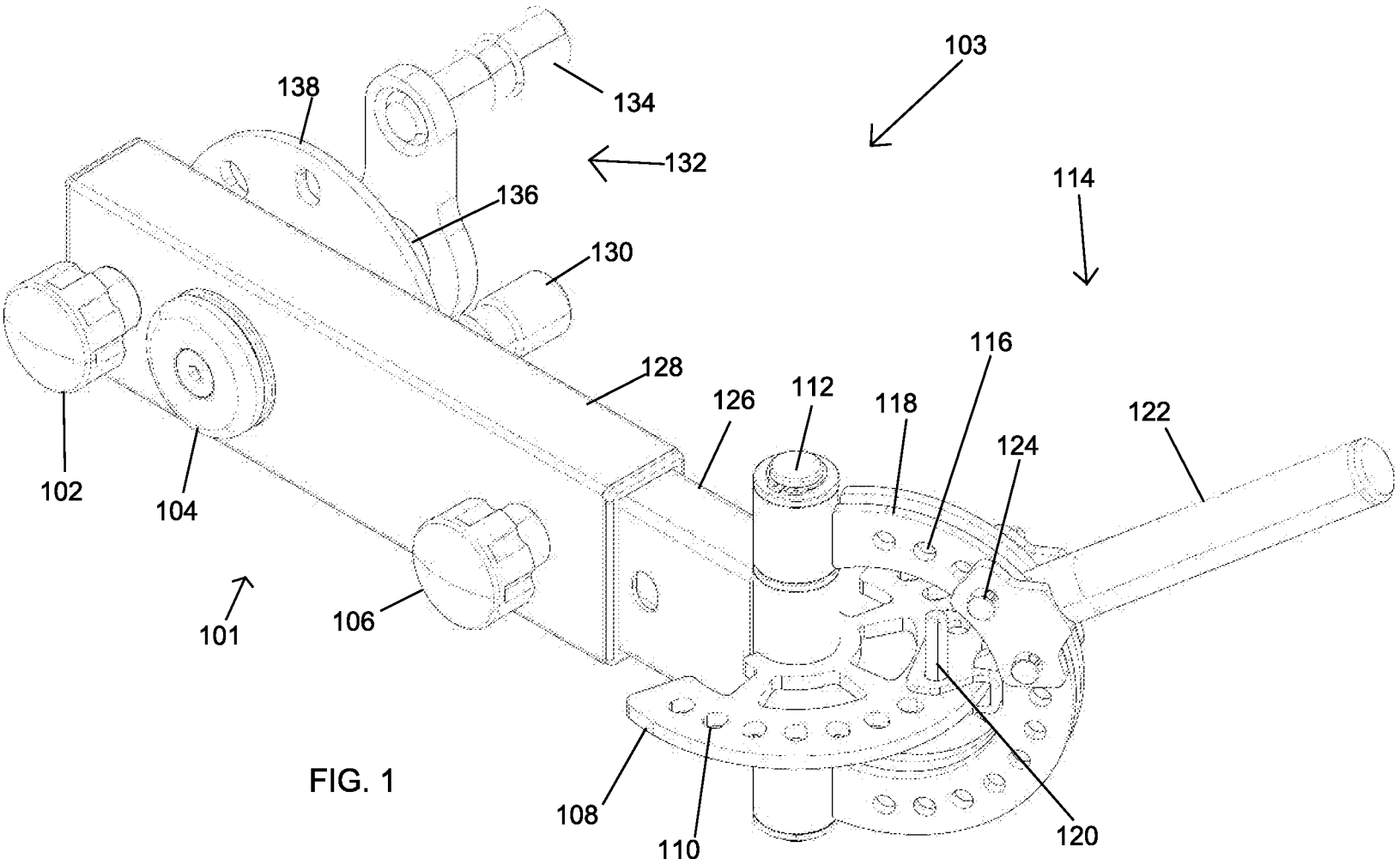
FIG. 1 is an angled, perspective view of a handle attachment system for use with an exercise machine in accordance with the present invention.
Figure 2:
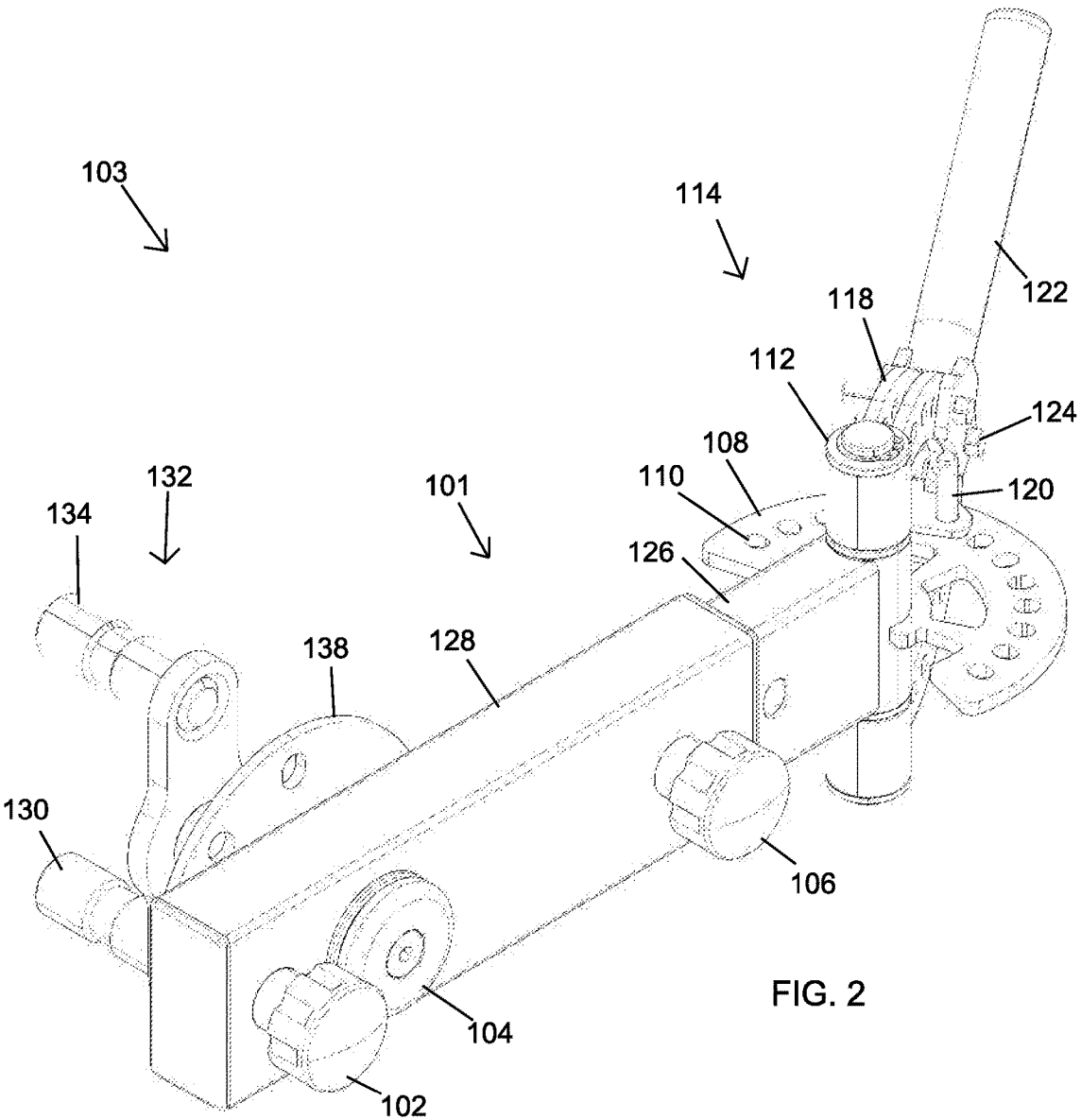
FIG. 2 is another angled, perspective view of the handle attachment system of FIG. 1.
Figure 3:
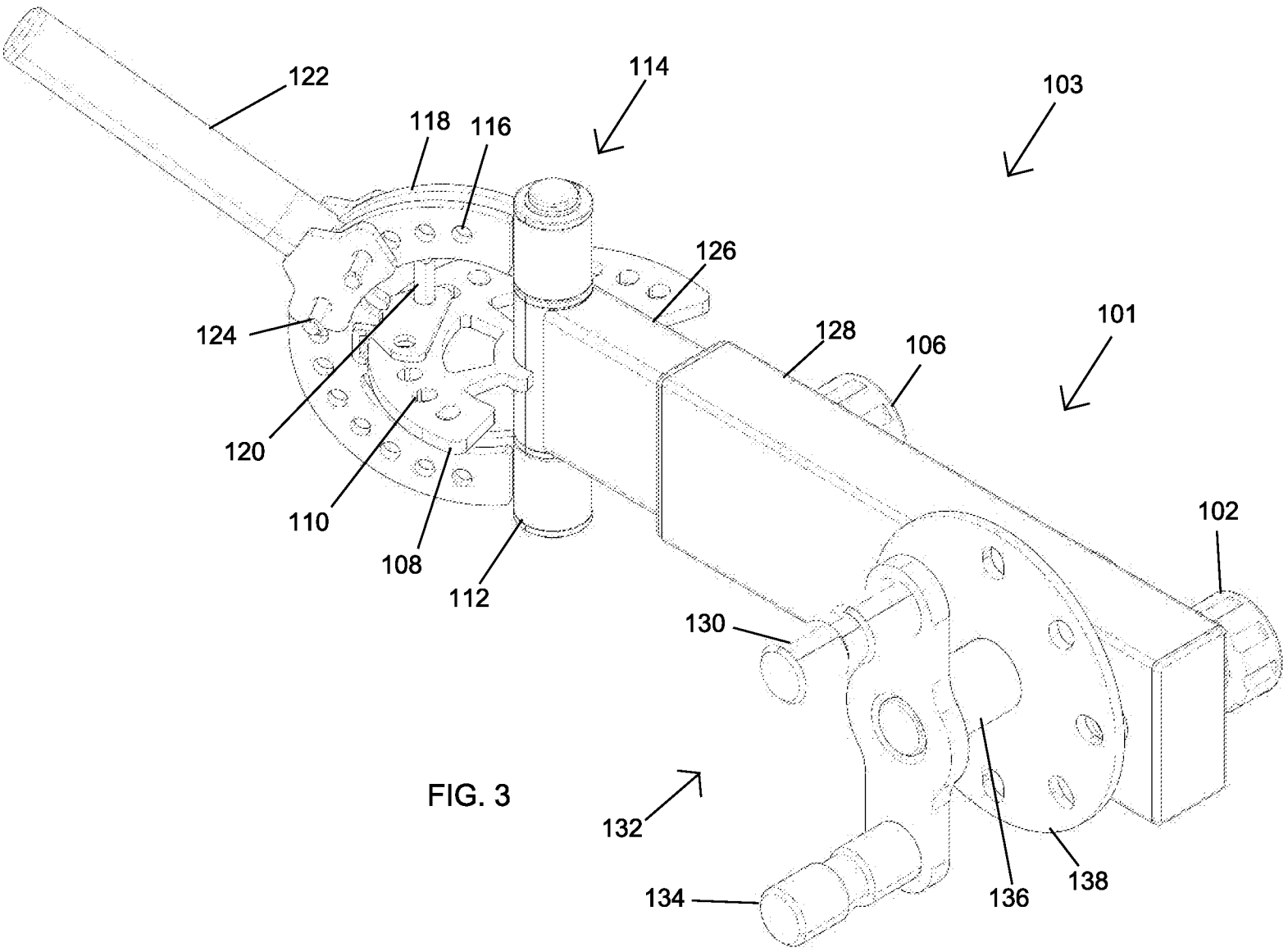
FIG. 3 is another angled, perspective view of the handle attachment system of FIG. 1.
Figure 4:
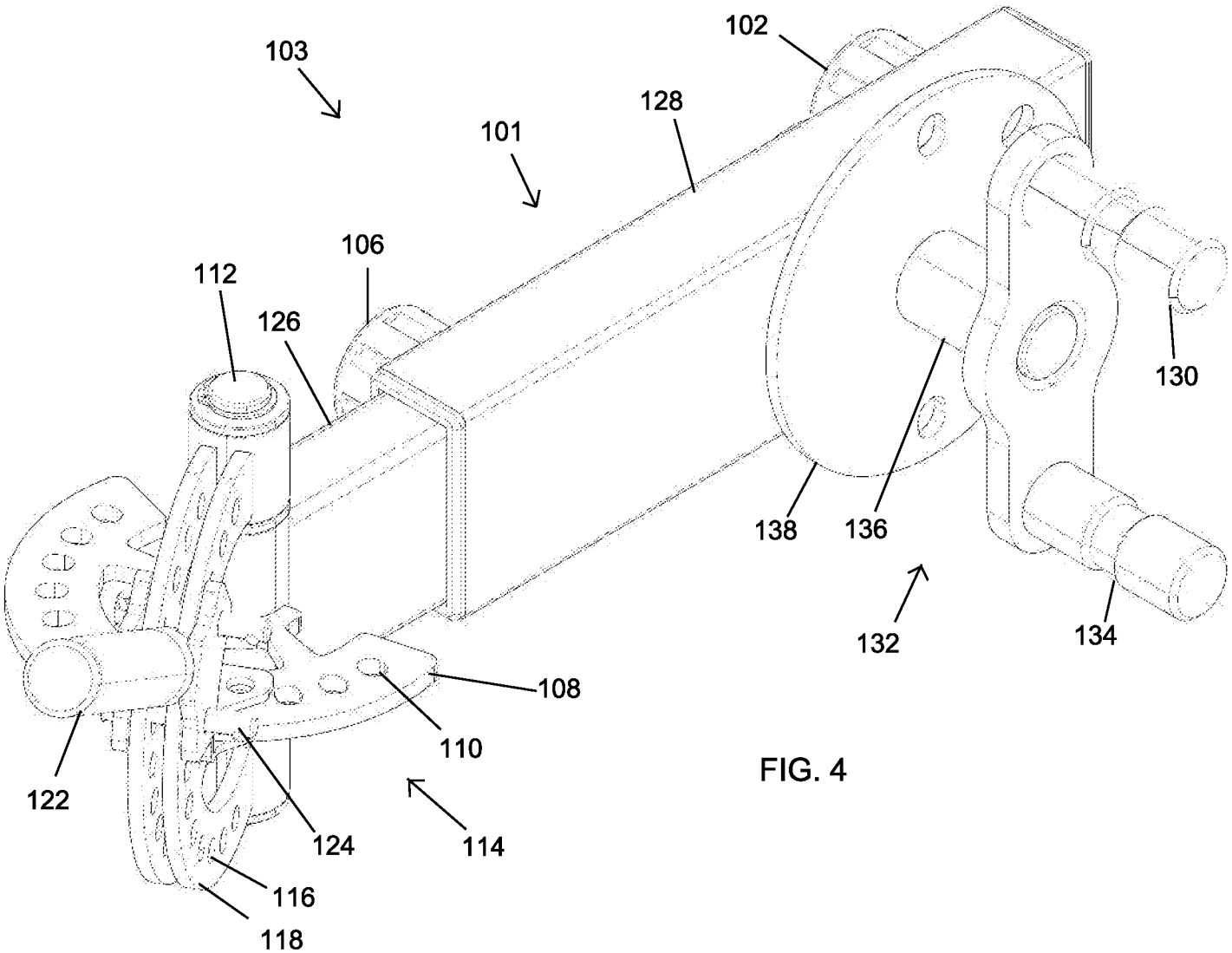
FIG. 4 is another angled, perspective view of the handle attachment system of FIG. 1.

The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Exercise equipment is well known in the art and varies from complex machinery to simple devices, wherein a user may select various equipment based on their needs. Those skilled in the art will recognize that adjustability in exercise equipment is desirable. For example, a user may desire to adjust positions of equipment components to fit their body size, as well as to fit desired movements. Accordingly, the present invention provides for a handle attachment system that is configured to engage with an exercise machine, such as a jammer arm, lever arm, smith unit, smith machines, or other exercise equipment, wherein the handle attachment system includes three connections such that a handle can be adjusted in three different directions, or along three different axes. The ability to adjust the handle in three directions provides for a plurality of benefits. Specifically, this allows for the user to adjust the handle position based on their body size, arm length, height, etc., and further allows for adjustment based on the machine that the handle is being utilized with and the exercise being performed.

In FIGS. 1 through 4, a handle attachment system 103 is shown. It should be appreciated that depending on the desired exercise, multiple handle attachment systems 103 may be used, such as one for each hand. System 103 includes a support 101 extending from a first end to a second end, the support 101 engaged with the attachment mechanism 132 at the first end and an adjustment system 114 at the second end. The support 101 in embodiments, is adjustable, such as by having a first bar 126 telescoping engaged with a second bar 128. The support 101 may secure at a desired length via one or more locks 106.

Figure 5:
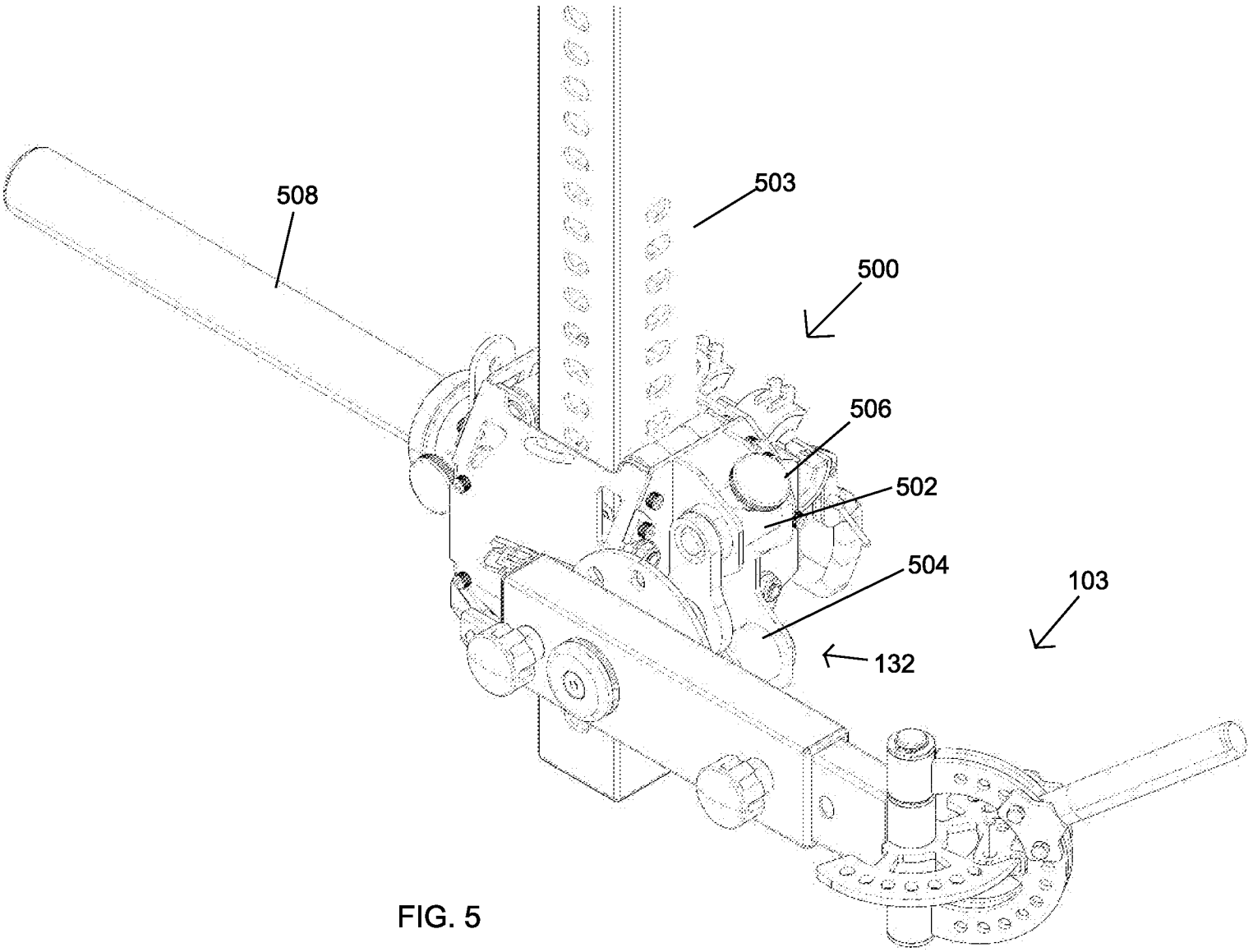
FIG. 5 is an angled, perspective view showing the handle attachment system of FIG. 1 attached to a first exercise machine as an example.
Figure 6:
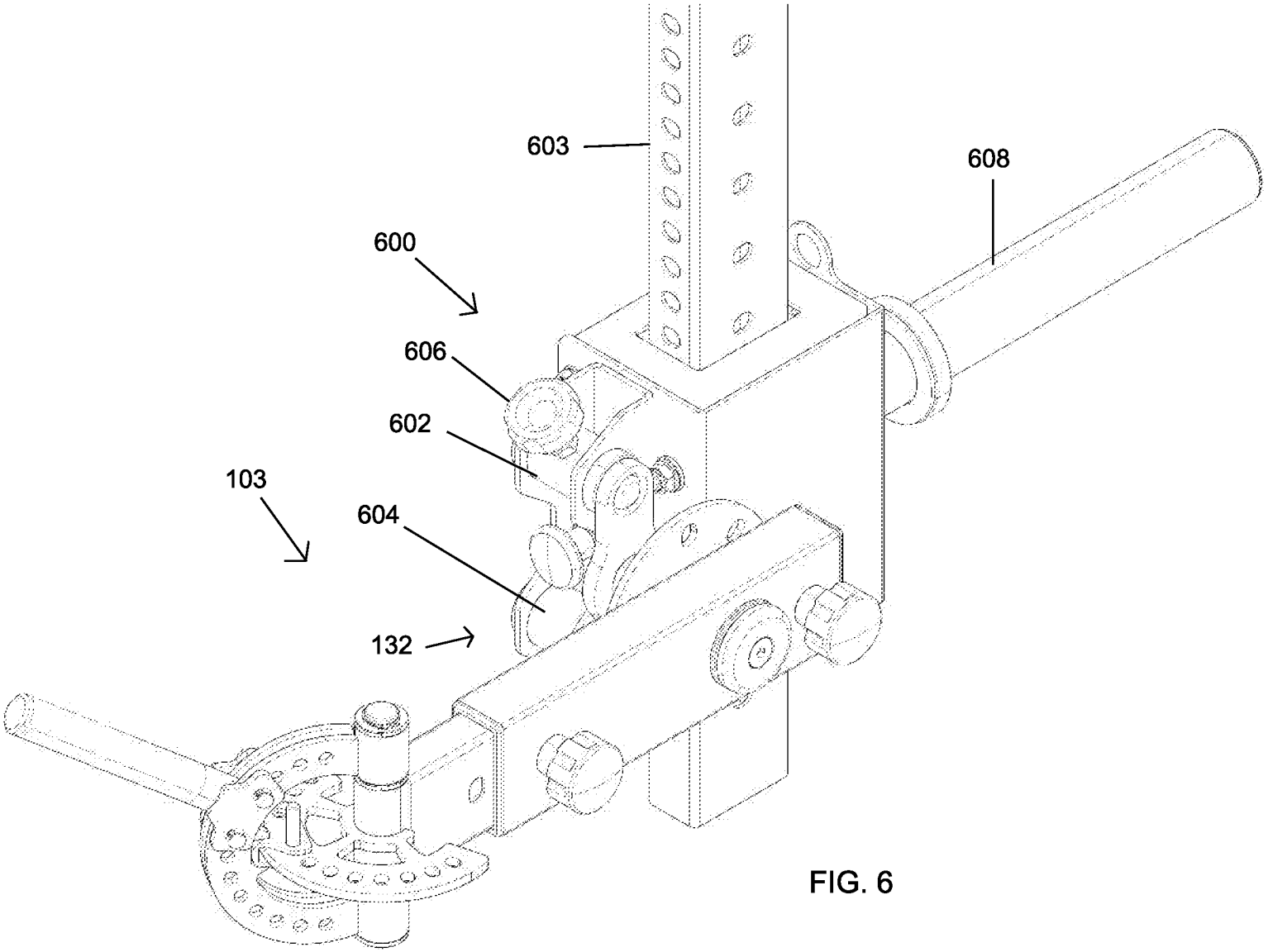
FIG. 6 is an angled, perspective view showing the handle attachment system of FIG. 1 attached to a second exercise machine as an example.

The attachment mechanism 132 in embodiments, includes a plate 138 attached to the associated support 101. The plate 138 may be configured to rotate and secured at a desired position via a lock 102. A T-bar 136 extends from the associated plate 138 such that dual bars 134, 130 extend away from the plate 138. The bars 134, 130 are configured to engage with a selected exercise machine, as shown in FIGS. 5 and 6. For example, the bars may extend through apertures of a post, an arm, or other exercise machine, such that a handle is provided for user engagement.

The adjustment system 114 provides for adjustment of an associated handle 122 in three directions, or again, along three axes. Adjustment system 114 includes a first connection 112 providing pivoting adjustment along a first axis, a second connection 108 providing pivoting adjustment along a second axis, and a third connection 118 providing pivoting adjustment along a third axis.

In embodiments, the first connection 112 is a hinged connection configured to allow pivoting movement along the first axis about the hinged connection. The first connection 112 is connected directly to the associated support 101 in embodiments. The second connection 108 in embodiments, is a curved plate attached to and extending from the hinged connection, the curved plate providing a guide for movement along the second axis, the second axis being substantially perpendicular to the first axis. The second connection 108 having a plurality of apertures 110 such that as the handle 122 is pivoted along the second connection 108, the apertures 110 provide for locations to lock one or more pins 120 in place, thereby securing the associated handle 122 at a desired position along the second axis.

In embodiments, the third connection 118 is a curved support attached to and extending from the hinged connection, the curved support further engaged with the curved plate such that the curved support is configured to be guided by the curved plate along the second axis. The curved plate may include two identical plates as shown. A handle 122 is attached to the curved support such that the third support guides the handle along the third axis. Again, a plurality of apertures 116 can be used with one or more locking pins 124 to lock the handle 122 at a desired position along the third axis.

During use, the handle attachment systems 103 will attach to an exercise machine, via the attachment systems 132. The user will then adjust the handle 122 along the three axes to a desired position for the exercise movement to be performed. The user can then proceed to complete the exercise movement as desired.

In FIGS. 5 and 6, two examples shown the handle attachment system 103 attached to exercise equipment. As shown in FIG. 5, the attachment system 132 may engage with a carriage 500 of an exercise machine, the carriage having receiving ports 502, 504 to engage with the bars 130, 134 and lock via one or more pins 506. The carriage 500 configured to engage with a post 503 and configured to receive a user engageable device 508. The exact configuration of the carriage is non limiting to the present invention. Similarly, as shown in FIG. 6, another example of a carriage 600 is shown. Again, this carriage includes ports 602, 604 for receiving the bars 130, 134 to lock in place via one or more pins 606. The carriage 600 can receive a user engageable device 608 and engage with a post 603 as shown. Again, the examples shown in FIGS. 5 and 6 are non-limiting.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A handle attachment system for use with an exercise machine, the handle attachment system comprising:

an attachment mechanism for engaging with the exercise machine;

a support extending from a first end to a second end, the support engaged with the attachment mechanism at the first end;

an adjustment system engaged with the support at the second end, the adjustment system having:

a first connection providing pivoting adjustment along a first axis;

a second connection providing pivoting adjustment along a second axis; and a third connection providing pivoting adjustment along a third axis; and a handle attached to the adjustment system such that the handle is capable of being adjusted to a predetermined position pivot along one or more of the first axis, the second axis, and the third axis via an associated one or more of the first connection, the second connection, and the third connection.

2. The handle attachment system of claim 1, wherein the attachment mechanism further comprises:

a plate attached to the support; and one or more bars extending from the plate and configured to engage with the exercise machine.

3. The handle attachment system of claim 2, wherein the plate is capable of rotating relative to the support.

4. The handle attachment system of claim 2, further comprising:

a T-bar extending from the plate and supporting the one or more bars, the one or more bars being a first bar and a second bar.

5. The handle attachment system of claim 1, further comprising:

the first connection being a hinged connection configured to allow pivoting movement along the first axis about the hinged connection;

the second connection being a curved plate attached to and extending from the hinged connection, the curved plate providing a guide for movement along the second axis, the second axis being substantially perpendicular to the first axis; and the third connection being a curved support attached to and extending from the hinged connection, the curved support further engaged with the curved plate such that the curved support is configured to be guided by the curved plate along the second axis;

wherein the handle is attached to the curved support such that the third support guides the handle along the third axis.

6. The handle attachment system of claim 5, wherein the curved plate further comprises a plurality of apertures such that the third connection is capable of locking at a position along the curved plate via one or more of the plurality of apertures and one or more locking pins.

7. The handle attachment system of claim 5, wherein the curved support further comprises a plurality of apertures such that the handle is capable of locking at a position along the curved support via one or more of the plurality of apertures and one or more locking pins.

8. The handle attachment system of claim 1, wherein the support is adjustable in length.

9. The handle attachment system of claim 8, wherein the support is a telescoping support with one or more locks to lock the support at a predetermined length.

* * * * *